US008923710B2

(12) United States Patent
Robinson et al.

(10) Patent No.: US 8,923,710 B2
(45) Date of Patent: Dec. 30, 2014

(54) METHOD AND APPARATUS FOR MANAGING A PRINTING SYSTEM HAVING ONE OR MORE PRINTERS

(75) Inventors: David C. Robinson, Penfield, NY (US); Katherine Loj, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 217 days.

(21) Appl. No.: 13/618,675

(22) Filed: Sep. 14, 2012

(65) Prior Publication Data

US 2014/0079426 A1 Mar. 20, 2014

(51) Int. Cl.
*G03G 15/00* (2006.01)

(52) U.S. Cl.
USPC ..... 399/13; 399/81

(58) Field of Classification Search
USPC ..... 399/13, 81, 82, 158
See application file for complete search history.

(56) References Cited

U.S. PATENT DOCUMENTS

2008/0317505 A1* 12/2008 Kuo et al. ..... 399/223
2010/0123911 A1* 5/2010 Guay ..... 358/1.9
2011/0117487 A1* 5/2011 Shifley et al. ..... 430/124.1

* cited by examiner

*Primary Examiner* — David Bolduc
*Assistant Examiner* — Barnabas Fekete
(74) *Attorney, Agent, or Firm* — Ronald E. Prass, Jr.; Prass LLP

(57) ABSTRACT

An approach is provided for managing a printing system. The approach involves determining at least one printer of the printing system is capable of at least five-color printing. The approach also involves determining a print job to be processed by the printing system includes using a custom colorant. The approach further involves determining if the custom colorant is ready for use, if an alternative colorant is ready for use, or if any custom colorants or alternative colorants are within a predetermined proximity of the printer. The approach additionally involves causing a preview of an output of the print job to be rendered and displayed, causing the print job to be processed or held, and causing one or more colorants to be ordered or made ready for use if the print job is held.

16 Claims, 7 Drawing Sheets

METHOD AND APPARATUS FOR MANAGING A PRINTING SYSTEM HAVING ONE OR MORE PRINTERS

FIELD OF DISCLOSURE

The disclosure relates to an apparatus, method and system for managing a printing system.

BACKGROUND

Some printing systems support at least five-color printing. These printing systems render previews of five-color or greater print jobs using conventional cyan, magenta, yellow and black ("CMYK") formats that are converted to conventional red, green, blue ("RGB") formats for display. CMYK rendering formats do not accurately reflect how a fifth colorant would be printed by the printing system.

Five-color print jobs often require specific colorants to be used as the fifth color in addition to the conventional CMYK colors. Fifth colorants and/or acceptable alternative colorants are sometimes out of stock in times of need and/or a particular printer that is part of a printing system may not be able to process the print job for a multitude of reasons while other printers may. As such, a print job may not be able to be completed for some time.

SUMMARY

Therefore, there is a need for an approach to manage a printing system to provide at least a five-color preview based when necessary on specified or available colorants, to enable automated ordering of out of stock colorants, and to optimize the scheduling of print jobs across a printing system having one or more printers.

According to one embodiment, a method for managing a printing system having one or more printers comprises determining at least one printer of the printing system is capable of at least five-color printing, the five-color printing being based on using one or more of a cyan colorant, a magenta colorant, a yellow colorant, a black colorant, and a custom colorant. The method also comprises determining a print job to be processed by the printing system includes using the custom colorant. The method further comprises determining one or more of (1) the at least one printer has the custom colorant ready for use, (2) the at least one printer has another custom colorant ready for use, (3) the at least one printer has neither the custom colorant or the another custom colorant ready for use, (4) the custom colorant is in a predetermined proximity of the at least one printer, (5) the another custom colorant is in the predetermined proximity of the at least one printer, and (6) one or more other custom colorants is in the predetermined proximity of the at least one printer.

The method additionally comprises causing, at least in part, a series of preview options to be displayed associated with generating a preview of an output of the print job, the series of preview options comprising one or more of an option to render the preview using a representation of the custom colorant, an option to render the preview using a representation of the another custom colorant, an option to render the preview using a representation of at least one of the one or more other custom colorants, and an option to render the preview using one or more of cyan, magenta, yellow, and black. The method further comprises causing, at least in part, the preview of the output of the print job to be rendered and displayed based, at least in part, on a selected preview option.

According to another embodiment, an apparatus for managing a printing system having one or more printers comprises at least one processor, and at least one memory including computer program code for one or more computer programs, the at least one memory and the computer program code configured to, with the at least one processor, cause, at least in part, the apparatus to determine at least one printer of the printing system is capable of at least five-color printing, the five-color printing being based on using one or more of a cyan colorant, a magenta colorant, a yellow colorant, a black colorant, and a custom colorant. The apparatus is also caused to determine a print job to be processed by the printing system includes using the custom colorant. The apparatus is further caused to determine one or more of (1) the at least one printer has the custom colorant ready for use, (2) the at least one printer has another custom colorant ready for use, (3) the at least one printer has neither the custom colorant or the another custom colorant ready for use, (4) the custom colorant is in a predetermined proximity of the at least one printer, (5) the another custom colorant is in the predetermined proximity of the at least one printer, and (6) one or more other custom colorants is in the predetermined proximity of the at least one printer.

The apparatus is additionally caused to cause, at least in part, a series of preview options to be displayed associated with generating a preview of an output of the print job, the series of preview options comprising one or more of an option to render the preview using a representation of the custom color, an option to render the preview using a representation of the another custom color, an option to render the preview using a representation of at least one of the one or more other custom colors, and an option to render the preview using one or more of cyan, magenta, yellow, and black. The apparatus is also caused to cause, at least in part, the preview of the output of the print job to be rendered and displayed based, at least in part, on a selected preview option.

According to another embodiment, a computer-readable storage medium carries one or more sequences of one or more instructions which, when executed by one or more processors, cause, at least in part, an apparatus manage a printing system having one or more printers to determine at least one printer of the printing system is capable of at least five-color printing, the five-color printing being based on using one or more of a cyan colorant, a magenta colorant, a yellow colorant, a black colorant, and a custom colorant. The apparatus is also caused to determine a print job to be processed by the printing system includes using the custom colorant. The apparatus is further caused to determine one or more of (1) the at least one printer has the custom colorant ready for use, (2) the at least one printer has another custom colorant ready for use, (3) the at least one printer has neither the custom colorant or the another custom colorant ready for use, (4) the custom colorant is in a predetermined proximity of the at least one printer, (5) the another custom colorant is in the predetermined proximity of the at least one printer, and (6) one or more other custom colorants is in the predetermined proximity of the at least one printer.

The apparatus is additionally caused to cause, at least in part, a series of preview options to be displayed associated with generating a preview of an output of the print job, the series of preview options comprising one or more of an option to render the preview using a representation of the custom color, an option to render the preview using a representation of the another custom color, an option to render the preview using a representation of at least one of the one or more other custom colors, and an option to render the preview using one or more of cyan, magenta, yellow, and black. The apparatus is also caused to cause, at least in part, the preview of the output of the print job to be rendered and displayed based, at least in part, on a selected preview option.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for managing a printing system to provide at least a five-color preview when necessary based on specified or available colorants, to enable automated ordering of out of stock colorants, and to optimize the scheduling of print jobs across a printing system having one or more printers are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term colorant, or any variation thereof, refers to any of an ink, a toner, or other marking material that may be used to apply an image and/or text to a substrate.

As used herein, the term custom colorant refers to one or more of a colorant having magnetic ink character recognition ("MICR") properties, a MICR colorant associated with a MICR font, a colorant associated with a deviceN and/or separation color, any variations thereof, or any similarly unique colorants that differ from conventional CMYK colorants, for example.

As used herein, the term pre-flighting, or any derivation thereof, refers to a process of determining information included in a print job file including confirming that digital files required for a particular printing process are all present, correctly formatted, and of a desired type. Pre-flighting occurs at a time after a print job file is received.

Figure 1:
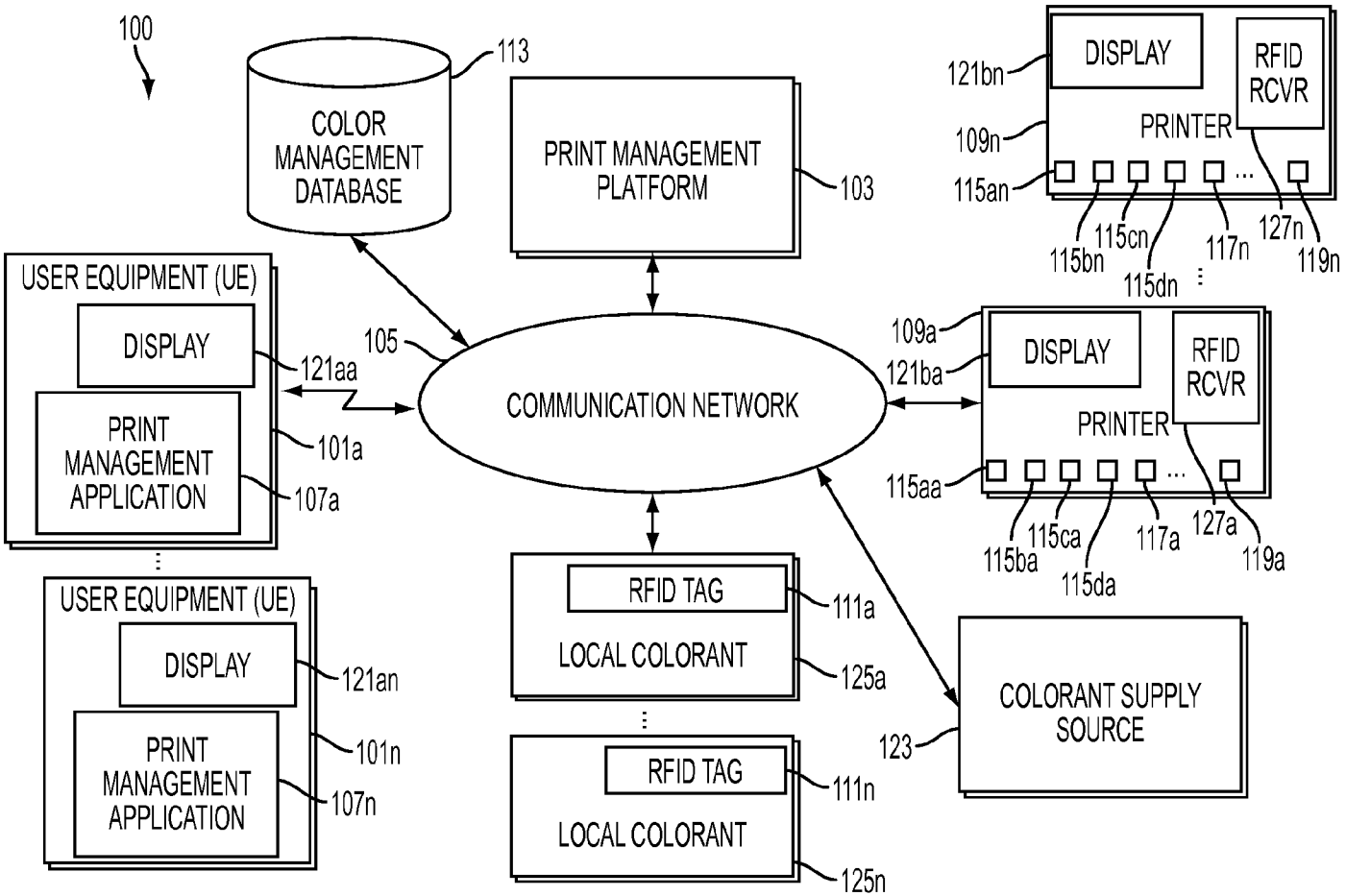
FIG. 1 is a diagram of a printing management system capable of at least five-color printing, according to one embodiment.

FIG. 1 is a diagram of a printing system 100 that provides at least a five-color preview when necessary based on specified or available colorants, enables automated ordering of out of stock colorants, and optimizes the scheduling of print jobs across one or more printers, according to various embodiments. Some printing systems support at least five-color printing. These printing systems render previews of five-color or greater print jobs using conventional CMYK formats that are converted to conventional RGB formats for display. Conventional CMYK rendering formats do not accurately reflect how a fifth colorant would be printed by the printing system.

Five-color print jobs often require specific colorants to be used as the fifth color in addition to conventional CMYK colors. Fifth colorants and/or acceptable alternative colorants, or any components thereof, are sometimes out of stock in times of need and/or a particular printer that is part of a printing system may not be able to process the print job for a multitude of reasons while other printers may. As such, a print job may not be able to be completed for some time.

To address this problem, a printing system 100 of FIG. 1 introduces the capability of determining when to provide at least a five-color preview based on specified or available colorants, to enable automated ordering of out of stock colorants, and to optimize the scheduling of print jobs across a printing system having one or more printers.

As shown in FIG. 1, the printing system 100 comprises one or more user equipment (UE) 101*a*-101*n* (collectively referred to as UE 101) having connectivity to a print management platform 103, one or more printers 109*a*-109*n* (collectively referred to as printer 109), one or more radio frequency identification ("RFID") tags 111*a*-111*n* (collectively referred to as RFID tag 111), a color management database 113, and one or more colorant supply sources 123*a*-123*b* (collectively referred to as colorant supply source 123) via a communication network 105.

By way of example, the communication network 105 of printing system 100 includes one or more networks such as a wired data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (WiFi), WiGig, wireless LAN (WLAN), Bluetooth®, Internet Protocol (IP) data casting, satellite, mobile ad-hoc network (MANET), and the like, or any combination thereof.

The UE 101 is any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, television receiver, radio broadcast receiver, electronic book device, game device, or any combination thereof, including the accessories and peripherals of these devices, or any combination thereof. It is also contemplated that the UE 101 can support any type of interface to the user (such as "wearable" circuitry, etc.).

The UE 101's include locally accessible print management applications 107*a*-107*n* (collectively referred to as print management application 107). The print management application 107 enables the UE 101 to be used to interact with the print management platform 103 to manage a print job, review and/or preview an output of a print job, and/or send and receive communications regarding various functions of the printing system 100, for example. In embodiments, the print management application has a graphical user interface ("GUI") that provides a plurality of options with which a user may interact.

According to various embodiments, the printing system 100 supports processing print jobs having five-color printing. For example, cyan colorant 115*aa*-115*an* (collectively referred to as cyan colorant 115*a*), magenta colorant 115*ba*-115*bn* (collectively referred to as magenta colorant 115*b*), yellow colorant 115*ca*-115*cn* (collectively referred to as yellow colorant 115*c*), and black colorant 115*da*-115*dn* (collectively referred to as black colorant 115*d*) are illustrated as being ready for use by printers 109*a*-109*n*. The cyan colorant 115*a*, magenta colorant 115*b*, yellow colorant 115*c*, and black colorant 115*d* represent the conventional first four colors in a conventional four color CMYK or greater printing process. The cyan colorant 115*a*, magenta colorant 115*b*, yellow colorant 115*c*, and black colorant 115*d* may be collectively referred to herein as "CMYK colorants 115." In addition to the CMYK colorants 115, the printers 109 have the capability to have additional colorants ready for use for five-color printing. For example, printers 109*a*-109*n* are illustrated as having at least a detected fifth colorant 117*a*-117*n* (collectively referred to as detected fifth colorant 117) ready for use. Some printers 109 of the printing system 100, however, may not be capable of supporting five-color printing and may be capable of only having the CMYK colorants 115 ready for use. Other printers 109 may be capable of five-color printing, but may not have a detected fifth colorant 117 ready for use at a time that a detection process occurs. Such a printer 109, however, may have a fifth colorant loaded or made ready for use on demand.

In other embodiments, the printing system 100 supports processing print jobs that require six-color printing or greater. As such, the printers 109*a*-109*n* may have any number of detected additional colorants 119*a*-119*n* to accommodate six-color or greater printing ready for use. It should be understood that while the following description is primarily discussed regarding five-color printing, but any expansion beyond five-color printing is similarly handled by the printing system 100 as discussed herein.

According to various embodiments, the fifth-color beyond the conventional CMYK colorants 115 can be a colorant having a color such as red, for example, a MICR, any made to order colorant, a job specified colorant, a deviceN or separation color call, or a user specified colorant, for example.

The print management platform 103 receives a print job from any of a UE 101 and/or any other print job source that sends the print job to the print management platform 103 for processing in the form of a print job file. The printing system 100 facilitates previewing an output of a received print job by way of one or more of displays 121*aa*-121*an* associated with any UE 101 or displays 121*ba*-121*bn* associated with any printer 109. Displays 121*aa*-121*an* and 121*ba*-121*bn* are collectively referred to as display 121. The preview reflects the fifth color plane called out within a print job file associated with the received print job based on specific criteria discussed below.

In embodiments, the print management platform 103 determines what type of fifth colorant is specified in the print job file. For example, the print management platform 103 determines if MICR is to be used as the fifth colorant, or if another colorant is to be used when processing the print job. When MICR is to be used as a fifth colorant on a print job, the print management platform 103 determines if an appropriate fifth colorant is ready for use on a printer 109 and/or within a predetermined proximity of a printer 109. For example, the print management platform 103 may determine if a detected fifth colorant 117 that is ready for use by a printer 109 matches the specified MICR (e.g. loaded or ready to be fed to a printer 109), the print management platform 103 may determine if the detected fifth colorant 117 that is ready for use does not match the specified MICR (e.g., some other fifth colorant such as a red colorant from a previous print job is the detected fifth colorant 117), the print management platform 103 may determine that no detected fifth colorant 117 is ready for use by the printer 109, the print management platform 103 may determine what other local colorants 125*a*-125*n* (collectively referred to as local colorant 125) that may include the specified MICR or other colorants that are available within the predetermined proximity of the printer 109 that may be used as the specified fifth colorant or acceptable alternative.

In embodiments, the print management platform 103 may poll the color management database 113 for any data regarding the MICR, any other colorants that may have been used by the printing system 100 or that may be stored as default information, or any data regarding the CMYK colorants 115 and any combination colors that may be made using the CMYK colorants 115 alone or in combination with any of the specified fifth colorant, the detected fifth colorant 117 that is ready for use at the printer 109, or local colorants 125 determined to be within the predetermined proximity of the printer 109. Such a query may be used to provide alternative options of the specified fifth colorant is not ready for use as a detected fifth colorant 117, or not available as a local colorant 125, for example.

For example, in one embodiment, the print management platform 103 receives a print job that the printing system 100 is to process. The print management platform 103 detects the presence of MICR fonts within print description language ("PDL") that is within a print job file associated with the given print job during a pre-fighting process. In various embodiments, when a user wants to preview an output of a five-color print job, the pre-flight operation is performed to determine if MICR fonts are present in the print job. The presence of MICR fonts, for example, may be determined by the print management platform 103 based on the detected presence of the following non-exclusive list of example font families:

1. CMC-7
2. E-13B
3. U+244x
4. U+245x.

If MICR fonts are present in the print job file, the print management platform 103 may cause a preview of an output of the print job to be generated for display using a designated representation of the MICR. For example, a MICR font may be rendered as "black" on a preview rendered by the print management platform 103. In other embodiments, the MICR font may be rendered as any color or combination of colors that may be specified by a user by way of a GUI of the print management application 107, for example, that may be generated when a MICR font is detected, or a GUI of the print management application 107 that may enable a user to predefine how a MICR font is to be rendered before a MICR font is detected to be present in the print job file.

The print management platform 103 determines the nature of the detected fifth colorant 117 that is ready for use through a device object of a digital front end ("DFE") of any of the printers 109. The print management platform 103 also determines if any other available local colorants 125 that may serve at the specified fifth colorant are within a predetermined proximity of any of the printers 109 based on one or more communications with one or more of the RFID tags 111 that are associated with one or more respective local colorants 125.

For example, an RFID tag 111 may be attached to or associated with a colorant bottle or packaging that contains a particular colorant. In some embodiments, the print management platform 103 may communicate with any RFID tags 111 in a predetermined proximity of the print management platform 103, any printer 109, and/or a UE 101. For example, each printer 109 may have a respective RFID receiver 127*a*-127*n* (collectively referred to as RFID receiver 127) that is in communication with various RFID tags 111 that are within the predetermined proximity. Alternatively, any of the UE 101 or print management platform may have their own respective communication modules that can receive RFID information from the various RFID tags 111.

For example, the print management platform 103 may determine that an RFID tag 111 associated with a particular color is inside a factory setting based on a range set by a user. In some embodiments, the range may be set at a particular level, expanded, or contracted on demand based on a user definition. The RFID information contained on an RFID tag 111 may contain a colorant name and/or CIELAB values for the colorant to enable identification of the colorant. The predetermined proximity may refer to one or more of a maximum range of detection of an RFID tag 111, or the predetermined proximity may refer to an acceptable distance that a detected RFID tag 111 may be from any of the RFID receivers 127 or determined location of a UE 101, for example, within which a colorant associated with an RFID tag 111 may be considered a local colorant 125. For example, if an RFID tag 111 is detected by the print management platform 103 and determined to be 500 feet away from a printer 109, but the predetermined proximity is set to be 300 feet away from a printer 109, then the colorant associated with the RFID tag 111 that is 500 feet away may not be considered to be a local colorant 125.

According to various embodiments, the print management platform 103 generates a set of one or more options that are presented on the GUI associated with the print management application 107 with which a user may interact to specify how the specified fifth colorant is to be previewed. The preview, as discussed above, and/or the GUI of the print management application 107 may be presented to a user by way of at least one display 121. Additionally, or alternatively, the specification as to how the specified fifth colorant is to be previewed may be based on a job ticketing instruction. In embodiments, the user may have any combination of the following options for rendering and displaying a preview of an output of the print job to be processed by the printing system 100:

1. Use a color representative of a detected fifth colorant 117 determined to be ready for use by a printer 109, e.g. a loaded color;

2. Use a color representative of a local colorant 125 that is determined to be within the predetermined proximity of a printer 109. If this option is selected, the print management platform 103 may cause a presentation of an array of any local colorants 125 that are available within the predetermined proximity;

3. Use a user specified color, a menu of colors, or a palette of colors that is to be presented to the user to represent the specified fifth colorant; and/or 4. Use an extended color defined in the print job file, e.g. a representative color of the specified fifth colorant only. In embodiments, the colorant definition is accomplished via either:

a. Name match (e.g., "Pantone 101U")

b. Alternative color match for either RGB, CMYK or Lab defined values.

For example, if a MICR font is detected in the pre-flight operation, and depending on which selection is made when the MICR font is detected, the print management platform 103, using decompose and raster image processing ("RIP") facilities that may be incorporated into the print management platform 103 or associated with the printing system 100, may map the MICR fonts to a black colored output for previewing the output of the print job, using a CMYK (i.e. the black portion) format for preview. Alternatively, MICR fonts could be displayed as a non-K100% color (e.g., gray), or as any of the alternative selections discussed above, to enable easier user detection of the MICR plane information in the preview generated by the print management platform 103 and presented on display 121. For example, the MICR font could be rendered based on a user selected value as indicated by way of a GUI of the print management application 107, as discussed above.

If no MICR fonts are detected, the print management platform 103 determines in the pre-flight operation if any deviceN or separation color calls are present in the print job file. Depending on the user selection (e.g., the above-mentioned job ticketing or GUI selection), one of the deviceN or separation colors will be presented in the preview generated by print management platform 103.

In some embodiments, regardless of whether a MICR font or a deviceN or separation color is detected, the GUI associated with the print management application 107 may include preview choices, such as those discussed above, as well as a color patch or series of patches for representing the specified fifth colorant in the preview. The representation of the specified fifth colorant used for the preview, as discussed above, may be any of a detected fifth colorant 117 that is ready for use by the printer 109, regardless of whether the detected fifth colorant 117 that is ready for use corresponds to the specified fifth colorant called out in the print job file, or a potential local colorant 125 determined to be in the predetermined proximity of a printer 109, UE 101 and/or print management platform 103.

For the preview, the mapping of one or more color patches that represent various fifth color plane choice(s) that correspond with the specified fifth colorant may be accomplished by mapping the CIELAB value(s) of a detected fifth colorant 117 that is ready for use and/or any potential local colorants 125 that are within the predetermined proximity through either a monitor profile or a sRGB (i.e., a monitor approximation).

According to various embodiments, if multiple deviceN/separation colorants are called out in the print job file associated, additional or alternative options may be added to the GUI to specify how the multiple colors are to be previewed. If the printing system 100, or any printer 109 is configured for five-color printing, the print management platform 103 may be configured to facilitate rendering a representation of only one extra colorant, i.e. a fifth colorant, beyond the conventional CMYK colorants 115, since the printing system or any printer 109, may not have the ability to process any additional colorants.

However, if the printing system 100, or printer 109 is configured for a particular number of color printing capabilities beyond five-color printing, then a corresponding number of representations of additional colorants may be previewed for any number of additional colorants beyond the conventional CMYK colorants 115 that are specified in the print job file up to the number of colorants the printing system 100 or printer 109 is capable of processing. For example, if the printing system 100 is configured for six-color printing, then the printing system 100 can accommodate two additional colorants beyond the conventional CMYK colorants 115. That is, the preview may include a specified fifth colorant and one additional specified colorant. But, if the user chooses, for example, an option available in the GUI of the print management application 107 that does not lead to the using the specified fifth colorant or any additional specified colorant, the print management platform 103 uses only a CMYK 4-plane preview for rendering the preview for display.

In some embodiments, the because the preview may be displayed on any of the displays 121 discussed above, the preview may be displayed remote from a printer 109 on a UE 101 upstream or downstream from the printer 109, for example, or the preview could be viewed at any of the printers 109 of the printing system 100.

According to various embodiments, the print management platform 103 may provide print options on the GUI associated with the print management application 107 presented on any of the displays 121 that indicate, for example, (1) use only the exact specified fifth colorant called for in the print job file, whether the specified fifth colorant matches a detected fifth colorant 117 that is ready for use or the specified fifth colorant matches a local colorant 125 that is within the predetermined proximity, (2) use a CMYK colorant 115 batch as an acceptable alternative to the specified fifth colorant, or (3) use an acceptable alternative fifth colorant that is not an exact match for the specified fifth colorant such as a detected fifth colorant 117 that may be ready for use by the printer 109 or a local colorant 125 within the predetermined proximity but does not match the specified fifth colorant.

For example, if the print job file associated received by the print management platform 103 have deviceN and separation color space calls within, or job ticketing and/or a user selection made by way of the GUI of the print management application 107 or at the printer 109 indicates that only an exact match with the specified fifth colorant can be used for printing, the print management platform 103 causes only the exact fifth colorant to be used for printing and enables only the designated representation of the specified fifth colorant for use in the preview. But, if the print job file or job ticketing instructions are not so specific, and/or if the specified fifth colorant is not available, then a user may direct the print management platform 103 to perform any of the options discussed above such as, for example, enable the print management platform 103 to use a CMYK colorant 115 batch to alternatively produce the specified fifth colorant when processing the print job and/or use a representation of the CMYK colorant 115 batch in place of a representation of the specified fifth colorant when generating the preview. Or, if the print job file or the job ticketing instructions are not so specific, the user may select that an alternative fifth colorant that does not match the specified fifth colorant but that is a detected fifth colorant 117 that is ready for use by the printer 109 or an alternative fifth colorant that does not match the specified fifth colorant that is a local colorant 125 determined to be within the predetermined proximity be used when processing the print job. Accordingly the generated preview and/or the print job is processed based on the alternative fifth colorant that is selected, and not the specified fifth colorant.

In some embodiments, if the print management platform 103 determines MICR fonts, deviceN, and/or separation calls are present in the file associated with the print job, MICR is assumed to be the specified fifth colorant. Otherwise if no MICR is determined to be called out by the print job, the device/separation call(s) are the candidates to be the specified fifth colorant.

If the specified fifth colorant, or any acceptable alternative fifth colorant, is not detected as being a detected fifth colorant 117 but determined to be within the predetermined proximity as a local colorant 125, the print job may be put in a hold state to wait for the specified fifth color or acceptable alternative colorant to be made ready for use. If the specified fifth colorant or an acceptable alternative fifth colorant is not available, or not determined to be within the predetermined proximity, then the print job is set to a hold status and the specified fifth colorant, or an acceptable alternative fifth colorant, is automatically ordered by the print management platform 103 from a networked colorant supply source 123. The colorant supply source 123 may be any number of colorant providers including inside and outside providers such as inside materials management groups, various warehouses that store colorant outside the predetermined proximity, or outside vendors.

For example, if a MICR font is detected, the print management platform 103 determines if the MICR is ready the detected fifth colorant 117 by interrogating a device object of the printer 109 or if the MICR colorant is a local colorant 125 via RFID information as communicated by any RFID tags 111. If the MICR is not the detected fifth colorant 117, the print job is set to the hold state. If the MICR is not the detected fifth colorant 117, and the MICR is not determined to be a local colorant 125 within the predetermined proximity, the specified fifth colorant (i.e. the MICR in this example) is ordered by any of entering the specified fifth colorant needed in a database such as the color management database 113 that is periodically polled by a colorant supply source 123, an ftp request that is sent by the print management platform 103 to a colorant supply source 123, or a browser request at least processed through the print management platform 103, and in some embodiments, controlled from a UE 101 or printer 109, to a colorant supply source 123, for example.

Similarly, if no MICR fonts are detected, the print management platform 103 determines if any deviceN or separation color calls are present in the print job file job. If the user chooses (e.g., via job ticketing or GUI selection) to use the file specified color as the specified fifth colorant, the print management platform 103 determines if the color requested is supported by the printing system 100 either by querying the color management database 113 for colors supported (e.g., by name of LAB value), or by a range of LAB values supported by the printing system 100. If the specified fifth colorant is not supported, the print job is printed using a CMYK colorant 115 combination. If the specified fifth colorant is supported, the print management platform 103 determines if the specified fifth colorant is the detected fifth colorant 117 ready for use by a printer 109 by interrogating a device object of the printer 109 or by determining if the specified fifth colorant is a local colorant 125 within the predetermined proximity. If the specified fifth colorant is not ready for use or in the predetermined proximity, the specified fifth colorant is ordered, as discussed above.

In some embodiments, if the specified fifth colorant is not available (i.e. not within the predetermined proximity) or not ready for use by a printer 109, the print management platform 103 may be configured to determine whether a potential alternative fifth colorant is within the predetermined proximity based on communicated information from the RFID's 111. The print management platform 103 may also determine if an alternative fifth colorant or a CMYK colorant 115 combination is an acceptable alternative for the specified fifth colorant. An alternative fifth colorant is acceptable if the alternative fifth colorant is within an acceptable tolerance around the specified fifth colorant called out in the print job file. The acceptable tolerance may be set as a default allowable difference between the specified fifth colorant and any determined alternative fifth colorant that is either a detected fifth colorant 117 that is ready for use, or a local colorant 125 determined to be within the predetermined proximity, or a CMYK colorant 115 combination. In some embodiments, the acceptable tolerance may be user-defined.

If the tolerance is determined to be met, then the print management platform 103 allows the print job to be previewed and/or processed. If any potential alternative fifth colorant, whether it is a detected fifth colorant 117 that is ready for use, a local colorant 125 that is within the predetermined proximity, or a combination of CMYK colorants 115 is determined to be outside the acceptable tolerance for an alternative to the specified fifth colorant, the print management platform 103 causes the print job to be put in a hold state and the specified fifth colorant, or an acceptable alternative colorant, is ordered by the print management platform 103, as discussed above.

In embodiments, the color comparison between the print job file specified color can be done, for example, by any of a name match where both the colorant called out in the print job file and the detected fifth colorant 117/local colorant 125 are identical, or based on an RGB, CMYK or Lab alternative space for determining PDL color matches for the values associated with the detected fifth colorant 117/local colorant 125 color.

According to various embodiments, the printing system 100 may include one or more printers 109 that may individually or together process one or more print jobs that are received by the print management platform 103. Print job files provided to the print management platform 103 have deviceN and/or separation color space calls within them and job ticketing and/or user selections based on made by way of the print management application 107, as discussed above, determine the proper handling of the specified fifth colorant if it is determined the print job has a specified fifth colorant. The print management platform 103 is configured to optimally direct print jobs, order supplies, and direct the making of specified and/or alternative fifth colorants ready for use across the one or more printers 109.

For example, if a print shop includes 10 printers 109*a*-109*j*, the print management platform 103 manages the scheduling of various print jobs across all 10 printers 109*a*-109*j* and causes certain print jobs to be output by one printer 109*a*, certain groups of particular printers 109*b*-109*h*, or by all 10 printers 109*a*-109*j* based, at least in part, on printer availability, production efficiency, any determined detected fifth colorants 117 ready for use at any of the one or more printers 109 and any determined local colorants 125 that may be within the predetermined proximity of any of the one or more printers 109. In some embodiments, the predetermined proximity may encompass an entire manufacturing facility, or the predetermined proximity may be associated with each individual printer 109. Such a scenario may be applicable, for example, if the printing system 100 includes printers 109 that are widely spaced from one another in a manufacturing facility, or if the printers 109 are remotely located from one another at various geographic locations.

If a specified fifth colorant such as a MICR is to be used to produce a detected MICR font, and the specified fifth colorant is a detected fifth colorant 117 that is ready for use by one or more printers 109, for example based on an internet printing protocol ("IPP") status determination, the print job will be routed by the print management platform 103 to one or more of the printers 109 having the specified fifth colorant ready for use as a detected fifth colorant 117. Or, if the specified fifth colorant is not ready for use, the print management platform 103 queries the various printers 109 to determine if the specified fifth colorant or an acceptable alternative fifth colorant is a local colorant 125 within the predetermined proximity via an RFID communication, as discussed above. If the specified fifth colorant or an alternative fifth colorant is determined to be in the predetermined proximity of a particular printer 109, the print job is sent to the one or more printers 109 having the specified fifth colorant or the alternative fifth colorant within the predetermined proximity for processing.

In one or more embodiments, the print management platform 103 may provide an option to select which potential printers 109 may be used to process the print job, or if all of the potential printers 109 that meet the specified fifth colorant or alternative fifth colorant criteria are to be used for processing the print job. When the print job instruction is sent to a particular printer 109, various job instructions for processing the print job, for making the specified fifth colorant or an acceptable alternative fifth colorant ready for use and/or to specify the location of a local colorant 125 to be used as the specified fifth colorant or alternative fifth colorant may also be sent. The print job instruction may be sent including job ticketing information which is highlighted on the GUI of the print management application 107, and/or by text message to a mobile device such as a UE 101 via the print management application 107 or a wireless service provider, for example. The text message may also indicate which printer(s) 109 are to process the print job based on the job scheduling determination made by the print management platform 103. In some embodiments, particular UE 101's may be associated with specific operators of specific printers 109. The text message may then be sent to a UE 101 assigned to an operator that is associated with a particular printer 109. Alternatively, the text message may be sent to a printer 109 so that it may be displayed on a display 121*b* of a particular printer 109 so that an operator of that particular printer may receive the requisite print job instruction.

By way of example, the UE 101, print management platform 103, printer 109, RFID tag 111, color management database 113, and colorant supply source 123 communicate with each other and other components of the communication network 105 using well known, new or still developing protocols. In this context, a protocol includes a set of rules defining how the network nodes within the communication network 105 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 2:
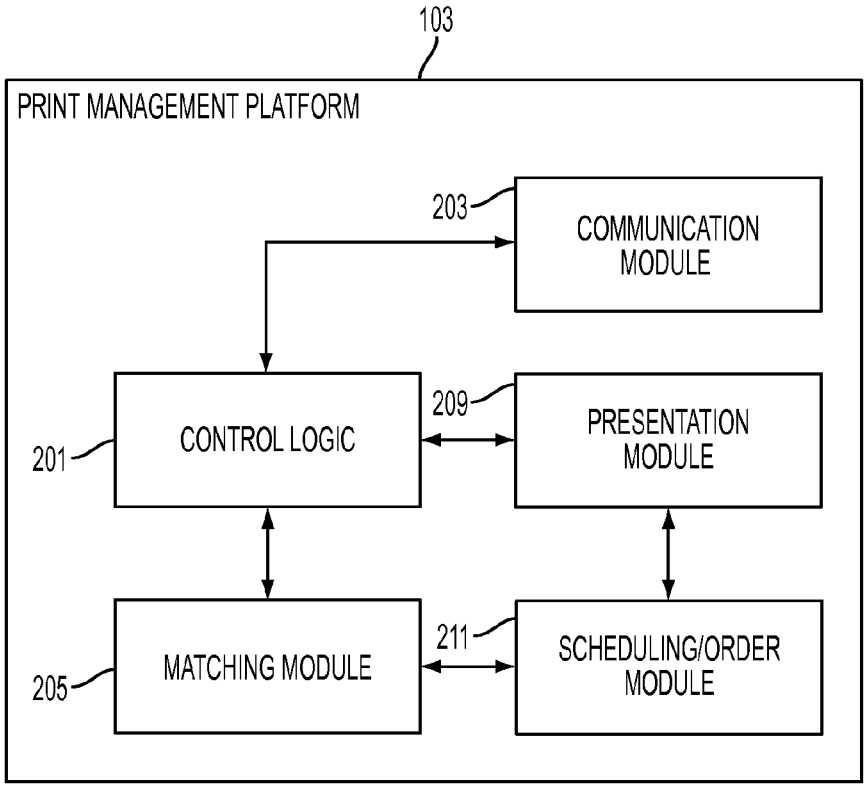
FIG. 2 is a diagram of the components of print management platform, according to one embodiment.

FIG. 2 is a diagram of the components of the print management platform 103, according to one embodiment. By way of example, the print management platform 103 includes one or more components for managing a printing system to provide at least a five-color preview when necessary based on specified or available colorants, to enable automated ordering of out of stock colorants, and to optimize the scheduling of print jobs across a printing system having one or more printers. It is contemplated that the functions of these components may be combined in one or more components or performed by other components of equivalent functionality. In this embodiment, the print management platform includes a control logic 201, a communication module 203, a matching module 205, a presentation module 209, and a scheduling/order module 211.

According to various embodiments, the print management platform 103 receives various print jobs in the form of print job files, for example, by way of the communication module 203. The control logic 201 determines in a pre-flight process if any specified fifth colorants are called for in the print job file, as discussed above. The control logic 201 instructs the matching module 205 to determine if any specified fifth colorants are ready for use as a detected fifth colorant 117 or are within a predetermined proximity as a local colorant 125 by causing one or more communications with any of a printer 109 and/or any RFID tags 111, for example. The matching module 205 then considers any information received from the printer 109 and any RFID information to determine if a detected fifth colorant 117 or if a local colorant 125 is a match for the specified fifth colorant, or if any of the detected fifth colorant or local colorant, or any CMYK colorants 115 can be used as an acceptable alternative to the specified fifth colorant, as discussed above. If any of the colorants match, or can be used as an acceptable alternative to the specified fifth colorant, the scheduling/order module 211 causes the print job to be processed, or queued for processing (e.g. temporarily held until a local colorant 125 may be made ready for use), by any optimally available printer 109, as discussed above. But, if the specified fifth colorant or an acceptable alternative colorant is not available, then the scheduling/order module 211 causes the print job to be put into a hold status so that the specified fifth colorant or an acceptable alternative colorant may be ordered. The scheduling/order module 211 causes the specified fifth colorant or the acceptable alternative colorant to be ordered by communicating with a colorant supply source 123, as discussed above, by way of the communication module 203.

In one or more embodiments, the control logic 201 instructs the presentation module 209 to render a preview image of an output of the received print job based on any criteria set by a user interaction with the print management application 107, as discussed above. The presentation module 209, in some embodiments, may include a decompose and RIP facility, such as that discussed above, to render the preview.

According to various embodiments, the control logic 201 causes any of the matching module 205, the presentation module 209, and/or the scheduling/order module 211 to communicate with the color management database 113 by way of the communication module 203 as necessary to perform various respective tasks such as searching the color management database 113 for job related information or color related information, as well as for storing an order sheet for a colorant supply source 123.

Figure 3:
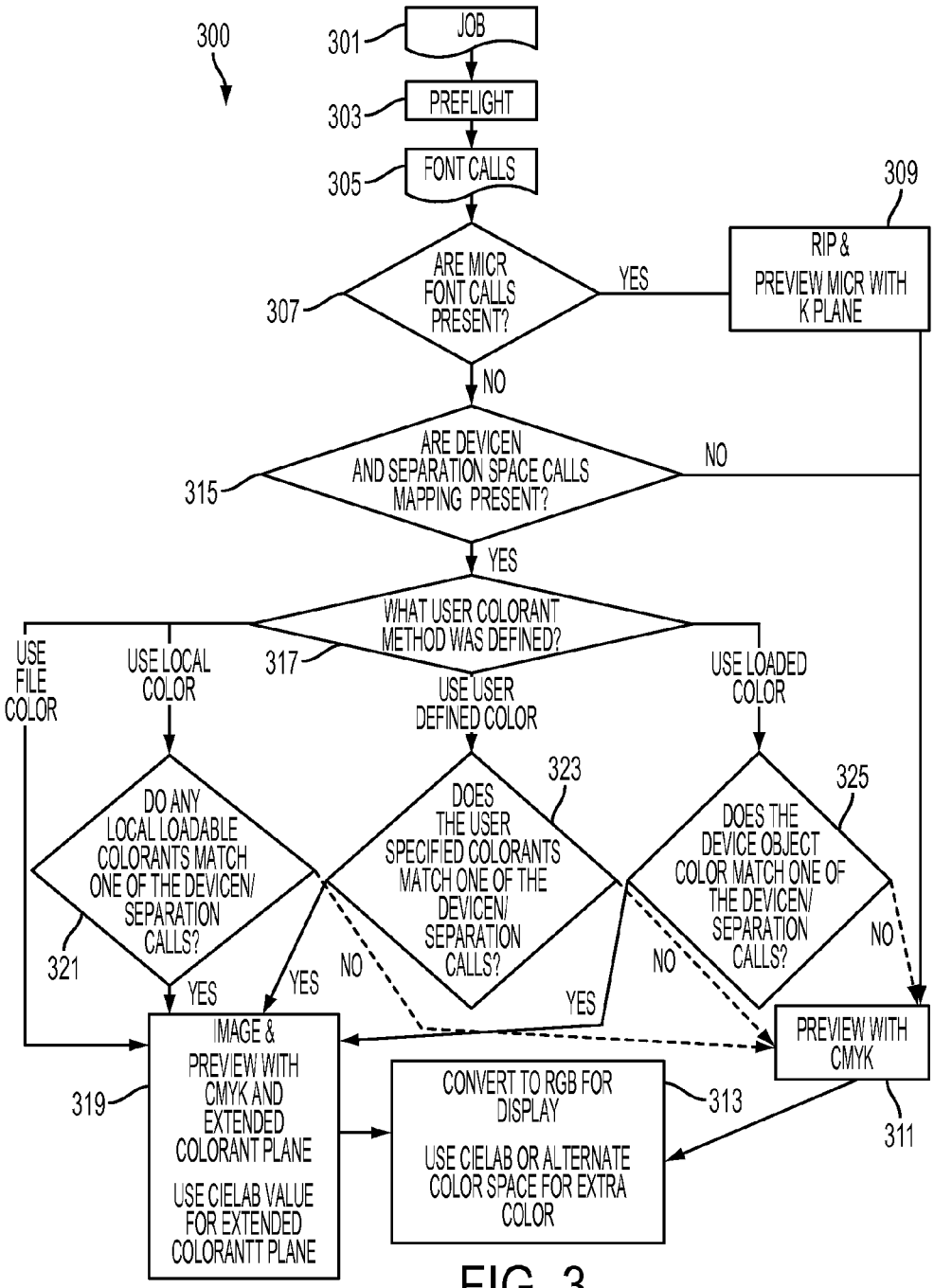
FIG. 3 is a flowchart of a process for managing a rendering of a preview for a print job to be output by a printing system, according to one embodiment.
Figure 7:
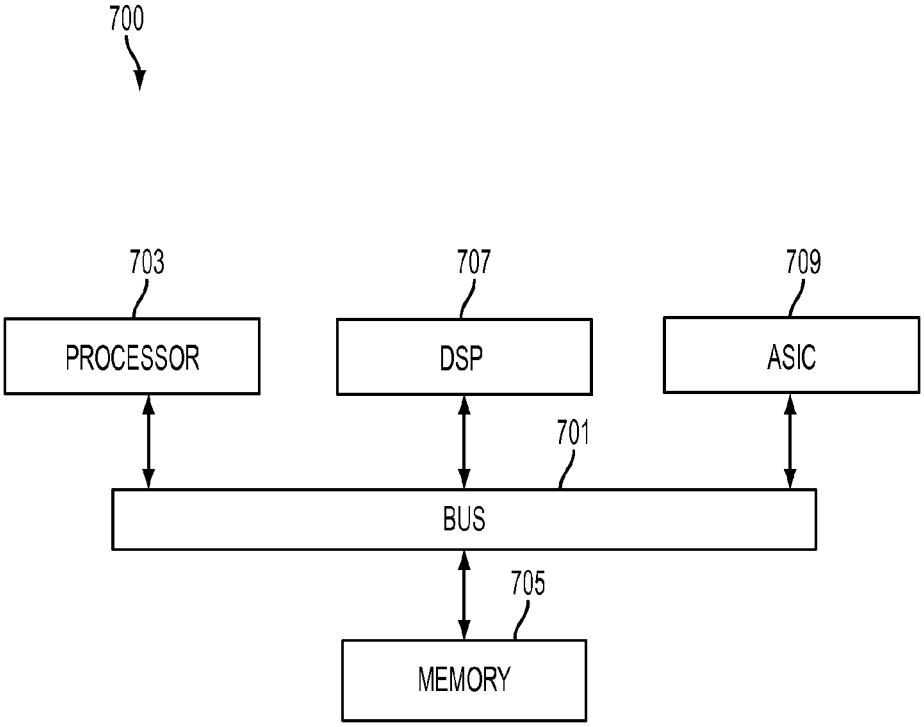
FIG. 7 is a diagram of a chip set that can be used to implement an embodiment.

FIG. 3 is a flowchart of a process for managing a printing system to provide at least a five-color preview based when necessary on specified or available colorants, according to one embodiment. In one embodiment, the print management platform 103 performs the process 300 and is implemented in, for instance, a chip set including a processor and a memory as shown in FIG. 7. In step 301, the print management platform 103 receives a print job file. In step 303, the print management platform 103 performs a pre-flight process. Then, in step 305, the print management platform 103 determines if any font calls are made in the print job file. Next, in step 307, the print management platform 103 determines if any MICR font calls are present in the print job file.

If the print management platform 103 determines MICR font calls are present, the process continues to step 309. In step 309, the print management platform 103 causes a preview of the print job to be rendered and the MICR to be represented in the rendered preview as a black color. Next, in step 311, the print management platform 103 causes any other portions of an image that is to be printed as instructed by the print job file to be rendered and previewed using conventional CMYK colors and color combinations. Then, in step 313, the print management platform 103 causes the preview of the print job including the MICR preview portion and the CMYK preview portion to be converted to an RGB format for presentation on display 121. In this embodiment, a CIELAB or alternate color may be used as a representation of the specified fifth colorant if such a selection is chosen by the user by way of the print management application 107 GUI, as discussed above.

If the print management platform 103 determines that MICR font calls are not present in the job file, then the process continues to step 315 in which print management platform 103 determines if the print job file has any deviceN and separation space calls present. If no, the process continues to step 311 and the print job is previewed using CMYK colors, and the preview is converted to RGB for presentation on a display 121 in step 313.

But, if the print management platform 103 determines any deviceN and separation space calls present, the print management platform 103 additionally determines the quantity of deviceN and separation space calls in step 315. Then the process continues to step 317 in which the print management platform 103 consults the print management application 107 to determine which preview method a user selected. The user selected preview method not only includes how to display a detected deviceN and separation color, but also includes, in a case where the quantity of deviceN and separation color calls is more than one, which of the more than one deviceN and separation color calls should be rendered. For example, if the printer 109 is capable of five color printing, then the user may select only one of the more than one deviceN and separation color calls to be rendered, or if the printer 109 is capable of six color printing, the user may select up to two of the more than one deviceN and separation color calls to be rendered. In other words, the user has control of how many of any determined multiple deviceN and separation color calls that may be detected may be rendered based on the maximum number of color capability beyond the conventional CMYK colorants 115 regardless of how many deviceN and separation color calls are present in the print job file.

For any determined one or more deviceN and separation color calls present in a print job file, the process continues to any of steps 319, 321, 323 and 325 for each of the determined one or more deviceN and separation colors based on a determined user selected preview method in step 317.

If the user indicated by way of the print management application 107 GUI that the specified fifth colorant should be used (e.g. the deviceN colorant), the print management platform 103 causes the print job to be previewed using the CMYK colorants 115 and the specified fifth colorant using CIELAB values for the specified fifth colorant in step 319.

If the user indicated by way of the print management application 107 GUI that a local colorant 125 should be used, the process continues to step 321 in which the print management platform 103 determines if any available local colorants 125 match the specified fifth colorant. If the available local colorant 125 matches the specified fifth colorant, the process continues to step 319 in which the print management platform 103 causes the print job to be previewed using the CMYK colorants 115 and the specified fifth colorant using CIELAB values for the specified fifth colorant. The preview is then converted to RGB for presentation on a display 121 in step 313 and CIELAB values are used to represent the specified fifth colorant.

If the print management platform 103 determines the available local colorant 125 does not match the specified fifth colorant, the process continues to step 311 in which the print management platform 103 causes the print job to be previewed using the CMYK colors. The preview is then converted to RGB in step 313 for presentation on a display 121, as discussed above.

If the user indicated by way of the print management application 107 GUI that a user defined colorant should be used, the process continues to step 323 in which the print management platform 103 determines if the user defined color matches any of the determined deviceN or separation color calls in the print job file. If yes, the process continues to step 319 in which the print management platform 103 causes the print job to be previewed using the CMYK colorants 115 and the user specified fifth colorant using CIELAB values for the specified fifth colorant. The preview is then converted to RGB for presentation on a display 121 in step 313 and CIELAB values are used to represent the specified fifth colorant. If no, the process continues to step 311 in which the print management platform 103 causes the print job to be previewed using the CMYK colors. The preview is then converted to RGB in step 313 for presentation on a display 121, as discussed above.

If the user indicated by way of the print management application 107 GUI that a detected fifth colorant 117 should be used, the process continues to step 325 in which the print management platform 103 determines if the detected fifth colorant 117 matches any of the determined deviceN or separation color calls in the print job file. If yes, the process continues to step 319 in which the print management platform 103 causes the print job to be previewed using the CMYK colorants 115 and the detected fifth colorant 117 using CIELAB values for the detected fifth colorant 117. The preview is then converted to RGB for presentation on a display 121 in step 313 and CIELAB values are used to represent the detected fifth colorant 117. If no, the process continues to step 311 in which the print management platform 103 causes the print job to be previewed using the CMYK colors. The preview is then converted to RGB in step 313 for presentation on a display 121, as discussed above.

Figure 4:
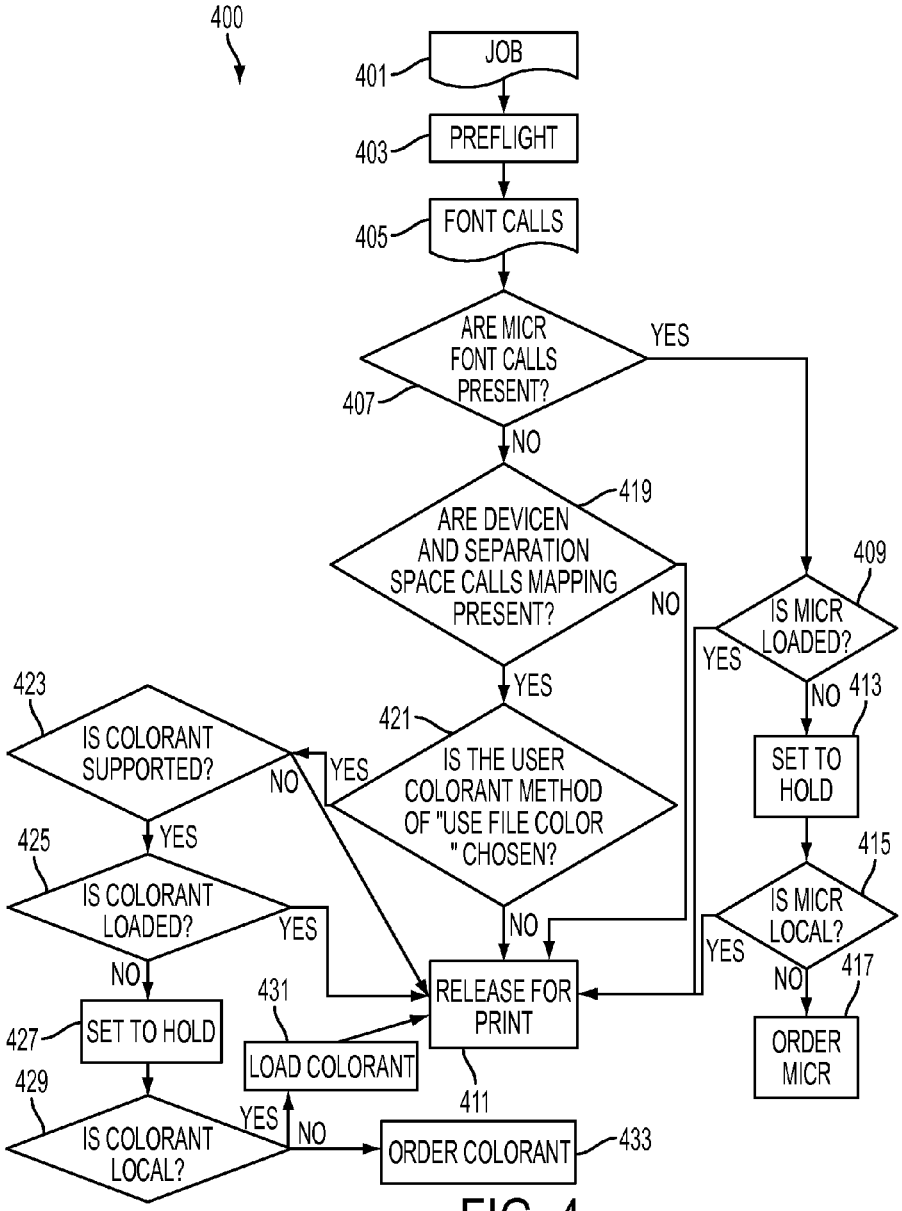
FIG. 4 is a flowchart of a process for managing a printing system using resourced based scheduling, according to one embodiment.

FIG. 4 is a flowchart of a process for enabling automated ordering of out of stock colorants, according to one embodiment. In one embodiment, the print management platform 103 performs the process 400 and is implemented in, for instance, a chip set including a processor and a memory as shown in FIG. 7. In step 401, the print management platform 103 receives a print job file. In step 403, the print management platform 103 performs a pre-flight process. Then, in step 405, the print management platform 103 determines if any font calls are made in the print job file. Next, in step 407, the print management platform 103 determines if any MICR font calls are present in the print job file.

If the print management platform 103 determines MICR font calls are present, the process continues to step 409. In step 409, the print management platform 103 determines if the MICR is ready for use by a printer 109. For example, the print management platform 103 determines if a detected fifth colorant 117 is the specified MICR. If the detected fifth colorant 117 is the specified MICR, then the print management platform 103 causes the print job to be released and processed by a printer 109 in step 411.

If the print management platform 103 determines that the detected fifth colorant 117 does not match the specified MICR, or if no fifth colorant is detected as being ready for use, the print management platform 103 sets the print job to a hold status in step 413. The print management platform 103 then, in step 415 determines if the specified MICR is a local colorant 125. If the specified MICR is a local colorant 125, then the process continues to step 411 in which the print management platform 103 causes the print job to be released and processed by a printer 109 once the specified MICR is made ready for use by the printer 109. If the print management platform 103 determines that the specified MICR, or an acceptable alternative fifth colorant, is not available as a local colorant 125 in step 415, the print management platform 103 automatically orders the specified MICR, or an acceptable alternative fifth colorant from a colorant supply source 123, in step 417.

If the print management platform 103 determines that there are no MICR fonts specified in the print job file, the process continues to step 419 in which the print management platform 103 determines if the print job file has any deviceN and separation space calls present. If no, the process continues to step 411 and the print job is released for printing using CMYK colorants 115 because the print job file does not contain any specified fifth colorants. If the print management platform 103 determines there are deviceN and/or separation color calls present in the print job file, the print management platform 103, in step 421, determines if the user selected a printing option to use the specified fifth colorant when processing the print job. If no, the print job is released for printing in step 411. If yes, the process continues to step 423.

In step 423, the print management platform 103 determines if the specified fifth colorant is supported by the printing system 100, or more specifically, by any printer 109. If no, the process continues to step 411 and the print job is released for printing using CMYK colorants 115. If yes, the process continues to step 425 in which the print management platform 103 determines if the specified fifth colorant is ready for use by a printer 109. For example, the print management platform 103 determines if a detected fifth colorant 117 matches the specified fifth colorant (i.e. the deviceN or separation color call). If the detected fifth colorant 117 is the specified fifth colorant, then the print management platform 103 causes the print job to be released and processed by a printer 109 in step 411.

If the print management platform 103 determines that the detected fifth colorant 117 does not match the specified fifth colorant, or if no fifth colorant is detected as being ready for use, the print management platform 103 sets the print job to a hold status in step 427. The print management platform 103 then, in step 429 determines if the specified fifth colorant is a local colorant 125. If the specified fifth colorant is a local colorant 125, then the process continues to step 431 in which the local colorant 125 is made ready for use, and then the process continues to step 411 in which the print management platform 103 causes the print job to be released and processed by a printer 109 once the specified fifth colorant is made ready for use by the printer 109. If the print management platform 103 determines that the specified fifth colorant is not available as a local colorant 125 in step 429, the print management platform 103 automatically orders the specified fifth colorant, or an acceptable alternative fifth colorant, from a colorant supply source 123 in step 433.

Figure 5:
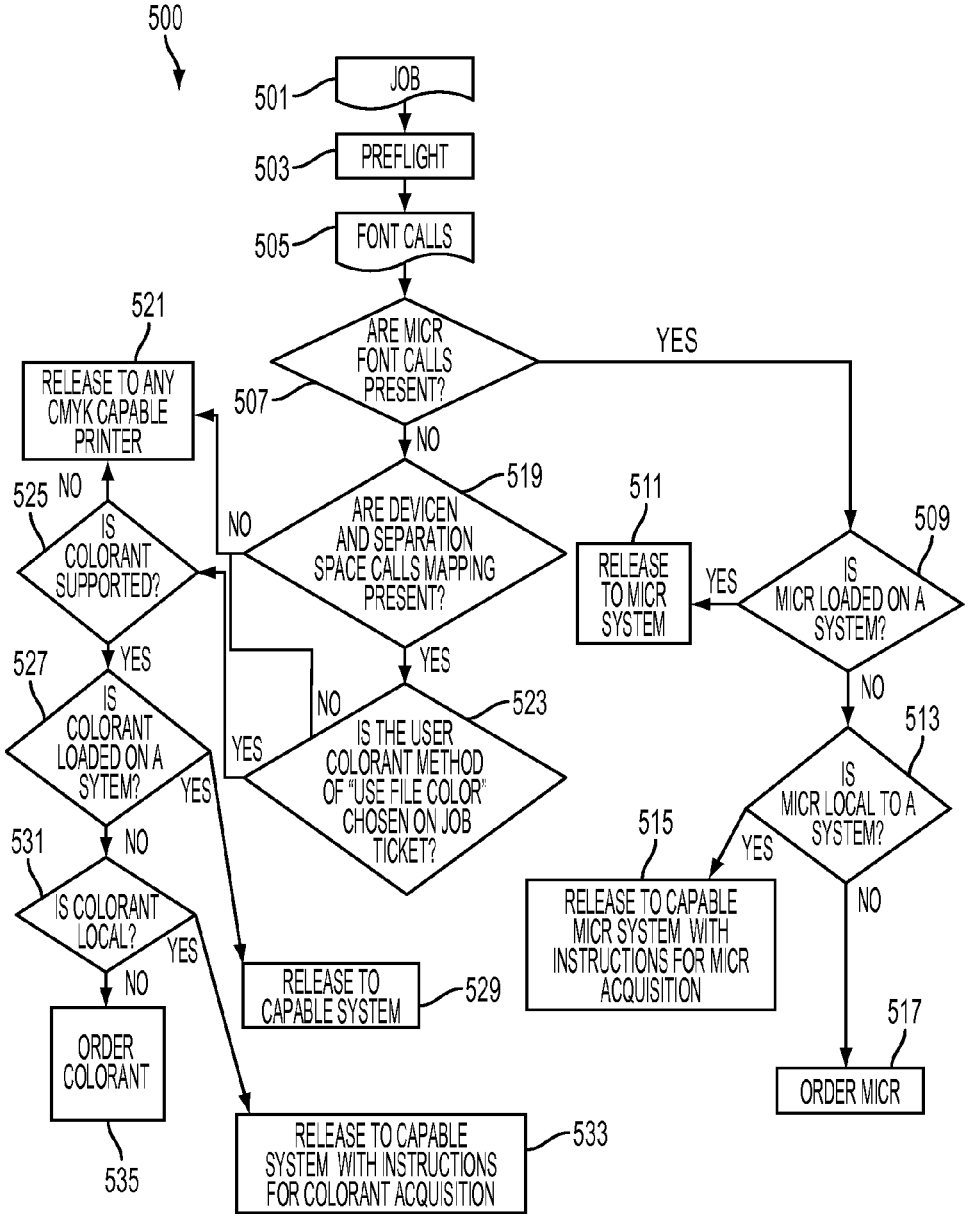
FIG. 5 is a flowchart of a process for managing a printing system having a plurality of printers, according to one embodiment.

FIG. 5 is a flowchart of a process for optimizing the scheduling of print jobs across a printing system having one or more printers, according to one embodiment. In one embodiment, the print management platform 103 performs the process 500 and is implemented in, for instance, a chip set including a processor and a memory as shown in FIG. 7. In step 501, the print management platform 103 receives a print job file. In step 503, the print management platform 103 performs a pre-flight process. Then, in step 505, the print management platform 103 determines if any font calls are made in the print job file. Next, in step 507, the print management platform 103 determines if any MICR font calls are present in the print job file.

If the print management platform 103 determines MICR font calls are present, the process continues to step 509. In step 509, the print management platform 103 determines if the MICR is ready for use by any of the printers 109. For example, the print management platform 103 determines if a detected fifth colorant 117 at any of the printers 109 is the specified MICR. If at least one of the detected fifth colorants 117 at any of the printers 109 is the specified MICR, then the print management platform 103 may cause the print job to be released and processed by at least one printer 109 in step 511. In embodiments, if more than one printer 109 is ready to use the specified MICR, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, and which printer(s) 109 are designated to process the print job.

If the print management platform 103 determines that the detected fifth colorant 117 does not match the specified MICR, or if no fifth colorant is detected as being ready for use, the print management platform 103 sets the print job to a hold status in step 513 while the print management platform 103 determines if the specified MICR is a local colorant 125. If the specified MICR is a local colorant 125, then the process continues to step 515 in which the print management platform 103 causes the print job to be released and processed by at least one printer 109 once the local colorant is made ready to use by at least one printer 109. In embodiments, if more than one printer 109 is has the local colorant 125 in the predetermined proximity, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, which printer(s) 109 are designated to process the print job, as well as instructions indicating the location of the local colorant 125, for example.

If the print management platform 103 determines that the specified MICR is not available as a local colorant 125 in step 517, the print management platform 103 automatically orders the specified MICR, or an acceptable alternative fifth colorant, from a colorant supply source 123 in step 517.

If the print management platform 103 determines that there are no MICR fonts specified in the print job file, the process continues to step 519 in which the print management platform 103 determines if the print job file has any deviceN and separation space calls present. If no, the process continues to step 521 and the print job is released for printing using CMYK colorants 115 because the print job file does not contain any specified fifth colorants. The print management platform 103 causes the print job to be released and processed by at least one printer 109 in step 521. In embodiments, if more than one printer 109 is ready to use the specified CMYK colorants 115, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, and which printer(s) 109 are designated to process the print job.

If the print management platform 103 determines there are deviceN and/or separation color calls present in the print job file, the print management platform 103, in step 523, determines if the user selected a printing option to use the specified fifth colorant when processing the print job. If no, the process continues to step 521 and the print job is released for printing using CMYK colorants 115 because the print job file does not contain any specified fifth colorants. The print management platform 103 causes the print job to be released and processed by at least one printer 109 in step 521. In embodiments, if more than one printer 109 is ready to use the specified CMYK colorants 115, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, and which printer(s) 109 are designated to process the print job.

If yes, the process continues to step 525. In step 525, the print management platform 103 determines if the specified fifth colorant is supported by the printing system 100, or more specifically, by any printer 109. If no, the process continues to step 521 and the print job is released for printing using CMYK colorants 115 because the print job file does not contain any specified fifth colorants. The print management platform 103 causes the print job to be released and processed by at least one printer 109 in step 521. In embodiments, if more than one printer 109 is ready to use the specified CMYK colorants 115, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, and which printer(s) 109 are designated to process the print job.

If yes, the process continues to step 527 in which the print management platform 103 determines if the specified fifth colorant is ready for use by any printer 109. For example, the print management platform 103 determines if a detected fifth colorant 117 at any of the printers 109 matches the specified fifth colorant (i.e. the deviceN or separation color call). If the detected fifth colorant 117 is the specified fifth colorant, then the print management platform 103 causes the print job to be released and processed by a printer 109 in step 529. In embodiments, if more than one printer 109 is ready to use the specified fifth colorant, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, and which printer(s) 109 are designated to process the print job.

If the print management platform 103 determines that the detected fifth colorant 117 does not match the specified fifth colorant, or if no fifth colorant is detected as being ready for use, the print management platform 103 sets the print job to a hold status in step 531 and determines if the specified fifth colorant is a local colorant 125. If the specified fifth colorant is a local colorant 125, then the process continues to step 533 in which the print management platform 103 causes the print job to be released and processed by one or more printers 109 once the specified fifth colorant is made ready for use by any printers 109 that are designated to process the print job. In embodiments, if more than one printer 109 is has the local colorant 125 in the predetermined proximity, the print management platform 103 will determine which of the printers 109 have capacity to process the print job. In some embodiments, the print management platform 103 may cause one or more equal portions of the print job to be divided among multiple printers 109, or the print management platform 103 may cause unequal portions of the print job to be processed by multiple printers 109 depending on determined printer capacity. When the print job is released to the one or more printers 109, a communication may be sent to at least one UE 101 indicating that the print job has been released, which printer (s) 109 are designated to process the print job, as well as instructions indication the location of the local colorant 125, for example.

If the print management platform 103 determines that the specified fifth colorant is not available as a local colorant 125 in step 531, the print management platform 103 automatically orders the specified fifth colorant, or an acceptable alternative fifth colorant, from a colorant supply source 123 in step 535.

Figure 6:
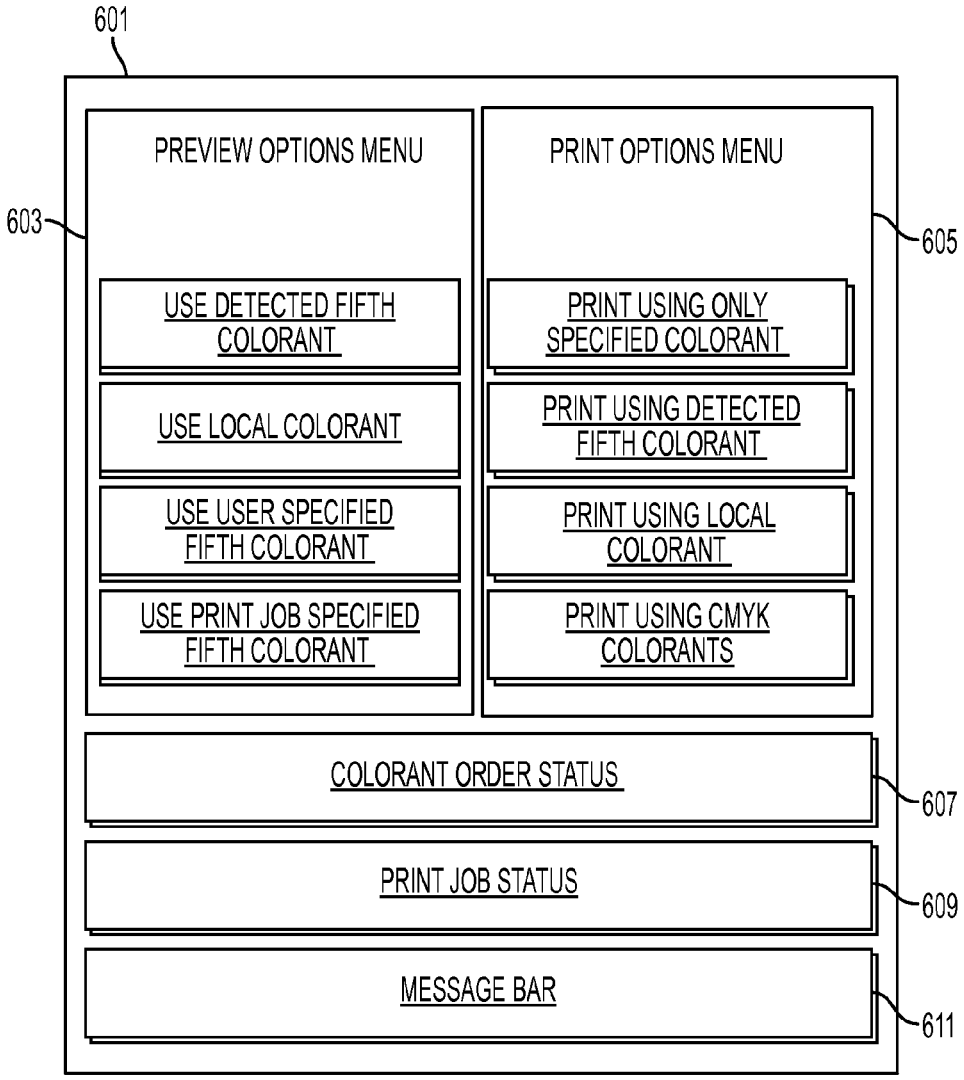
FIG. 6 is a diagram of a user interface for managing a printing system, according to one embodiment.

FIG. 6 is a diagram of user interfaces utilized in the processes of FIGS. 3-5, according to various embodiments. The print management application 107, as discussed above, includes a GUI 601. The GUI 601 includes preview options 603 and printing options 605. The GUI 601 is merely exemplary and may comprise any arrangement of features as well as any number of menus, tabs, and/or pages, for example.

In one example embodiment, the preview options 603 may include various options that a user may select for initiation a rendering of a print job preview such as an option to use the detected fifth colorant 117, an option to use a determined local colorant 125, an option to use another colorant that is a user specified colorant to represent the specified fifth colorant, or to use the specified fifth colorant as called out in the print job file. The print options 605 may include various options that a user may select related to releasing the print job such as an option to print the print job using only the print job filed specified fifth colorant, print using the detected fifth colorant 117, print using a local colorant 125, or print using CMYK colorants 115 (for example as a proofing scenario to conserve any available fifth colorants, whether specified fifth colorants, detected fifth colorants 117, or local colorants 124).

The preview options 603 and the print options 605 may also include various option settings such as a menu to set the extent of the predetermined proximity discussed above, or to view various available colorants as a sample color palate as discussed above. In other embodiments, the GUI 601 may also include a colorant order interface 607 that interacts with an ordering system that indicates what fifth colorants may be on order with a colorant supply source 123, a print job status menu 609 that indicates where and when various print jobs are being printed, a message bar 611 that may include, for example, a scrolling series of messages that indicate information regarding various print jobs or the overall status of the printing system 100, or may be a link to a menu that provides various messages about print jobs and/or the status of the printing system 100. In some embodiments, the message bar 611 may be a pop-up window that indicates information about a print job or includes instructions about a particular print job. Or, the message bar 611 may be illustrative of a text message received by a UE 101 that is communicated from the print management platform 103 by way of a wireless carrier, for example.

The processes described herein for managing a printing system to provide at least a five-color preview based when necessary on specified or available colorants, to enable automated ordering of out of stock colorants, and to optimize the scheduling of print jobs across a printing system having one or more printers may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 7 illustrates a chip set or chip 700 upon which an embodiment may be implemented. Chip set 700 is programmed to manage a printing system to provide at least a five-color preview when necessary based on specified or available colorants, to enable automated ordering of out of stock colorants, and to optimize the scheduling of print jobs across a printing system having one or more printers as described herein may include, for example, bus 701, processor 703, memory 705, DSP 707 and ASIC 709 components.

The processor 703 and memory 705 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 700 can be implemented in a single chip. It is further contemplated that in certain embodiments the chip set or chip 700 can be implemented as a single "system on a chip." It is further contemplated that in certain embodiments a separate ASIC would not be used, for example, and that all relevant functions as disclosed herein would be performed by a processor or processors. Chip set or chip 700, or a portion thereof, constitutes a means for performing one or more steps of managing a printing system to provide at least a five-color preview when necessary based on specified or available colorants, to enable automated ordering of out of stock colorants, and to optimize the scheduling of print jobs across a printing system having one or more printers.

In one or more embodiments, the chip set or chip 700 includes a communication mechanism such as bus 701 for passing information among the components of the chip set 700. Processor 703 has connectivity to the bus 701 to execute instructions and process information stored in, for example, a memory 705. The processor 703 may include one or more processing cores with each core configured to perform independently. A multi-core processor enables multiprocessing within a single physical package. Examples of a multi-core processor include two, four, eight, or greater numbers of processing cores. Alternatively or in addition, the processor 703 may include one or more microprocessors configured in tandem via the bus 701 to enable independent execution of instructions, pipelining, and multithreading. The processor 703 may also be accompanied with one or more specialized components to perform certain processing functions and tasks such as one or more digital signal processors (DSP) 707, or one or more application-specific integrated circuits (ASIC) 709. A DSP 707 typically is configured to process real-world signals (e.g., sound) in real time independently of the processor 703. Similarly, an ASIC 709 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 703 performs a set of operations on information as specified by computer program code related to managing a printing system to provide at least a five-color preview when necessary based on specified or available colorants, to enable automated ordering of out of stock colorants, and to optimize the scheduling of print jobs across a printing system having one or more printers. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 701 and placing information on the bus 701. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 703, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 703 and accompanying components have connectivity to the memory 705 via the bus 701. The memory 705 may include one or more of dynamic memory (e.g., RAM, magnetic disk, writable optical disk, etc.) and static memory (e.g., ROM, CD-ROM, etc.) for storing executable instructions that when executed perform the inventive steps described herein to manage a printing system to provide at least a five-color preview when necessary based on specified or available colorants, to enable automated ordering of out of stock colorants, and to optimize the scheduling of print jobs across a printing system having one or more printers. The memory 705 also stores the data associated with or generated by the execution of the inventive steps.

In one or more embodiments, the memory 705, such as a random access memory (RAM) or any other dynamic storage device, stores information including processor instructions for managing a printing system to provide at least a five-color preview when necessary based on specified or available colorants, to enable automated ordering of out of stock colorants, and to optimize the scheduling of print jobs across a printing system having one or more printers. Dynamic memory allows information stored therein to be changed by the printing system 100. RAM allows a unit of information stored at a location called a memory address to be stored and retrieved independently of information at neighboring addresses. The memory 705 is also used by the processor 703 to store temporary values during execution of processor instructions. The memory 705 may also be a read only memory (ROM) or any other static storage device coupled to the bus 701 for storing static information, including instructions, that is not changed by the printing system 100. Some memory is composed of volatile storage that loses the information stored thereon when power is lost. The memory 705 may also be a non-volatile (persistent) storage device, such as a magnetic disk, optical disk or flash card, for storing information, including instructions, that persists even when the printing system 100 is turned off or otherwise loses power.

The term "computer-readable medium" as used herein refers to any medium that participates in providing information to processor 703, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for managing a printing system having one or more printers comprising:

determining at least one printer of the printing system is capable of at least five-color printing, the five-color printing being based on using one or more of a cyan colorant, a magenta colorant, a yellow colorant, a black colorant, and a custom colorant;

determining a print job to be processed by the printing system includes using the custom colorant;

determining one or more of (1) the at least one printer has the custom colorant ready for use, (2) the at least one printer has another custom colorant ready for use, (3) the at least one printer has neither the custom colorant or the another custom colorant ready for use, (4) the custom colorant is in a predetermined proximity of the at least one printer, (5) the another custom colorant is in the predetermined proximity of the at least one printer, and (6) one or more other custom colorants is in the predetermined proximity of the at least one printer;

causing, at least in part, a series of preview options to be displayed associated with generating a preview of an output of the print job, the series of preview options comprising one or more of an option to render the preview using a representation of the custom colorant, an option to render the preview using a representation of the another custom colorant, an option to render the preview using a representation of at least one of the one or more other custom colorants, and an option to render the preview using one or more of cyan, magenta, yellow, and black; and causing, at least in part, the preview of the output of the print job to be rendered and displayed based, at least in part, on a selected preview option;

wherein the determination that any of the custom colorant, the another custom colorant, and the one or more other custom colorants is in the predetermined proximity of the at least one printer is based, at least in part, on a communication with one or more radio frequency identification tags respectively associated with the custom colorant, the another custom colorant, and the one or more other custom colorants.

2. A method of claim 1, wherein the representation of the custom colorant is rendered as a color corresponding to the custom colorant, as a user defined color, as a system-defined color, as a color comprising one or more of cyan, magenta, yellow and black, as a color corresponding to the another custom colorant, or as a color corresponding to one of the other custom colorants.

3. A method of claim 1, wherein the custom colorant is associated with a magnetic ink character recognition font.

4. A method of claim 1, further comprising:

causing, at least in part, the print job to be one of processed or held based, at least in part, on a specific print job requirement to use only the custom colorant or an acceptable alternative colorant, the acceptable alternative colorant being based, at least in part, on the another custom colorant, the one or more other custom colorants, the cyan colorant, the magenta colorant, the yellow colorant, and the black colorant.

5. A method of claim 4, further comprising:

determining the print job is held; and causing, at least in part, the custom colorant or the acceptable alternative colorant to be ordered by the printing system based, at least in part, on a communication with a networked colorant supply source.

6. A method of claim 5, wherein the communication with the networked colorant supply source is one or more of a browser-based communication, an FTP request, and a database polling.

7. A method of claim 4, further comprising:

causing, at least in part, the print job to be processed by the at least one printer of the printing system based, at least in part, on a determination that the at least one printer is ready to process the print job based on (1) the at least one printer has the custom colorant or the alternative acceptable colorant ready for use or (2) the custom colorant or the alternative acceptable colorant is within the predetermined proximity of the at least one printer.

8. A method of claim 7, further comprising:

determining the printing system comprises two or more printers;

determine at least one printer of the two or more printers is ready to process the print job;

causing, at least in part, the print job to be selectively processed by at least one printer of two or more printers that is ready to process the print job; and causing, at least in part, a message to be sent to at least one of the at least one printer of the two or more printers and a mobile device indicating which of the two or more printers is designated to process the print job.

9. An apparatus for managing a printing system having one or more printers comprising:

at least one processor; and at least one memory including computer program code for one or more programs, the at least one memory and the computer program code configured to, with the at least one processor, cause the apparatus to perform at least the following, determine at least one printer of the printing system is capable of at least five-color printing, the five-color printing being based on using one or more of a cyan colorant, a magenta colorant, a yellow colorant, a black colorant, and a custom colorant;

determine a print job to be processed by the printing system includes using the custom colorant;

determine one or more of (1) the at least one printer has the custom colorant ready for use, (2) the at least one printer has another custom colorant ready for use, (3) the at least one printer has neither the custom colorant or the another custom colorant ready for use, (4) the custom colorant is in a predetermined proximity of the at least one printer, (5) the another custom colorant is in the predetermined proximity of the at least one printer, and (6) one or more other custom colorants is in the predetermined proximity of the at least one printer;

cause, at least in part, a series of preview options to be displayed associated with generating a preview of an output of the print job, the series of preview options comprising one or more of an option to render the preview using a representation of the custom color, an option to render the preview using a representation of the another custom color, an option to render the preview using a representation of at least one of the one or more other custom colors, and an option to render the preview using one or more of cyan, magenta, yellow, and black; and cause, at least in part, the preview of the output of the print job to be rendered and displayed based, at least in part, on a selected preview option;

wherein the determination that any of the custom colorant, the another custom colorant, and the one or more other custom colorants is in the predetermined proximity of the at least one printer is based, at least in part, on a communication with one or more radio frequency identification tags respectively associated with the custom colorant, the another custom colorant, and the one or more other custom colorants.

10. An apparatus of claim 9, wherein the representation of the custom colorant is rendered as a color corresponding to the custom colorant, as a user defined color, as a system-defined color, as a color comprising one or more of cyan, magenta, yellow and black, as a color corresponding to the another custom colorant, or as a color corresponding to one of the other custom colorants.

11. An apparatus of claim 9, wherein the custom colorant is associated with a magnetic ink character recognition font.

12. An apparatus of claim 9, wherein the apparatus is further caused to:

cause, at least in part, the print job to be one of processed or held based, at least in part, on a specific print job requirement to use only the custom colorant or an acceptable alternative colorant, the acceptable alternative colorant being based, at least in part, on the another custom colorant, the one or more other custom colorants, the cyan colorant, the magenta colorant, the yellow colorant, and the black colorant.

13. An apparatus of claim 12, wherein the apparatus is further caused to:

determine the print job is held; and cause, at least in part, the custom colorant or the acceptable alternative colorant to be ordered by the printing system based, at least in part, on a communication with a networked colorant supply source.

14. An apparatus of claim 13, wherein the communication with the networked colorant supply source is one or more of a browser-based communication, an FTP request, and a database polling.

15. An apparatus of claim 12, wherein the apparatus is further caused to:

cause, at least in part, the print job to be processed by the at least one printer of the printing system based, at least in part, on a determination that the at least one printer is ready to process the print job based on (1) the at least one printer has the custom colorant or the alternative acceptable colorant ready for use or (2) the custom colorant or the alternative acceptable colorant is within the predetermined proximity of the at least one printer.

16. An apparatus of claim 15, wherein the apparatus is further caused to:

determine the printing system comprises two or more printers;

determine at least one printer of the two or more printers is ready to process the print job; cause, at least in part, the print job to be selectively processed by at least one printer of two or more printers that is ready to process the print job; and cause, at least in part, a message to be sent to at least one of the at least one printer of the two or more printers and a mobile device indicating which of the two or more printers is designated to process the print job.

* * * * *